US011214938B2

(12) United States Patent
Tang et al.

(10) Patent No.: US 11,214,938 B2
(45) Date of Patent: Jan. 4, 2022

(54) CONSTRUCTION METHOD FOR POURING CONCRETE IN KARST CAVE

(71) Applicants: GUANGZHOU INSTITUTE OF BUILDING SCIENCE CO., LTD., Guangzhou (CN); Guangzhou Construction Engineering Co., Ltd, Guangzhou (CN)

(72) Inventors: Mengxiong Tang, Guangzhou (CN); Hang Chen, Guangzhou (CN); Hesong Hu, Guangzhou (CN)

(73) Assignees: GUANGZHOU INSTITUTE OF BUILDING SCIENCE CO., LTD., Guangzhou (CN); GUANGZHOU CONSTRUCTION ENGINEERING CO., LTD, Guangzhou (CN)

( * ) Notice: Subject to any disclaimer, the term of this patent is extended or adjusted under 35 U.S.C. 154(b) by 0 days.

(21) Appl. No.: 16/880,722

(22) Filed: May 21, 2020

(65) Prior Publication Data

US 2021/0292987 A1 Sep. 23, 2021

(30) Foreign Application Priority Data

Mar. 19, 2020 (CN) ..... 202010196930.4

(51) Int. Cl.

| | |
|---|---|
| ***E02D 5/38*** | (2006.01) |
| ***E02D 5/36*** | (2006.01) |
| ***E21B 7/28*** | (2006.01) |

(52) U.S. Cl.

CPC ..... *E02D 5/38* (2013.01); *E02D 5/36* (2013.01); *E21B 7/28* (2013.01);

(Continued)

(58) Field of Classification Search

CPC combination set(s) only.

See application file for complete search history.

(56) References Cited

U.S. PATENT DOCUMENTS

| | | | | |
|---|---|---|---|---|
| 4,618,289 | A * | 10/1986 | Federer | E02D 5/385 405/233 |
| 2008/0260473 | A1* | 10/2008 | Smith | E02D 5/18 405/267 |
| 2010/0232887 | A1* | 9/2010 | Parsons | E02D 7/28 405/237 |

* cited by examiner

*Primary Examiner* — Kyle Armstrong

(57) ABSTRACT

The present application discloses a construction method for pouring concrete in a karst cave. Concrete streaming is pumped into a hollow passage of a drill stem, then opens the one-way openable sealing cover with a pre-tensioned spring on a reaming drill bit and enters the karst cave to complete pouring of the concrete. When the karst cave is relatively low, low-slump plain concrete mixed with quick-setting agents is injected through a drilling rig and the hollow drill stem to form a concrete pier; when the karst cave is relatively high, the hollow drill stem is sleeved into a thin-walled steel shell, and the thin-walled steel shell is synchronously sunk into the drilled hole while drilling, enters the karst cave and is socketed into a stable rock stratum, then concrete is pumped into the thin-walled steel shell from the bottom of the pile, and finally, a reinforcement cage is inserted to form a cast-in-place pile. Compared with the existing karst cave treatment methods, the construction method according to the present application can greatly reduce the consumption of materials, improve the mechanization of construction, simplify the construction process, shorten the construction period and reduce the engineering cost, and the cast-in-place pile with thin-walled steel shell, formed when the karst cave is relatively high, can further improve the bearing capacity of the foundation.

20 Claims, 15 Drawing Sheets

(52) U.S. Cl.
CPC ..... *E02D 2200/1685* (2013.01); *E02D 2250/0007* (2013.01); *E02D 2250/0023* (2013.01); *E02D 2300/002* (2013.01)

CONSTRUCTION METHOD FOR POURING CONCRETE IN KARST CAVE

TECHNICAL FIELD

The present application belongs to the technical field of foundation and foundation engineering, in particular to a construction method for pouring concrete in a karst cave.

BACKGROUND ART

Karst caves are underground spaces formed by karstification in soluble rocks. The formation of karst caves is the result of long-term corrosion of groundwater in limestone regions. China is a country with many karst caves, which account for about ¼ of the total area of karst in the subtropics of the world.

Construction on karst cave geology often requires necessary treatment to ensure that the foundation of a building has sufficient bearing capacity. At present, the main treatment method is to fill holes after drilling to reduce the risk of collapse caused by unstable hole structures, but this often results in waste of a lot of materials. At the same time, the existing construction method needs to fill a karst cave with sand, gravel and cement, then hammer the cave repeatedly, drill a hole again and pour concrete to form a pile with a large filling coefficient, so the cost is high, the construction procedures are excessive, and the construction period is long.

SUMMARY OF THE INVENTION

In order to solve the problems in the Background Art, the present application provides a construction method for pouring concrete in a karst cave, which can solve the technical problems of large consumption of karst cave treatment materials, many construction procedures, complicated processes, long construction period and the like, and further improve the bearing capacity of a foundation after treatment.

The present application adopts the following technical solution: A construction method for pouring concrete in a karst cave, including the following steps:

S1: mounting a one-way openable sealing cover at the slurry outlet of a reaming drill bit at the tail end of a hollow drill stem;

S2: mounting a drilling rig above the karst cave and mounting the hollow drill stem on the drilling rig;

S3: starting the power head of the drilling rig to perform positive drilling into the unstirred stratum, cleaning muck around the opening of the drilled hole, and stopping the drilling when the hollow drill stem touches the bottom surface of the karst cave if the depth of the karst cave is less than 3 m; or stopping the drilling when the hollow drill stem passes through the bottom surface of the karst cave and socketed into the stable rock stratum if the depth of the karst cave is more than 3 m;

S4: connecting the concrete outlet of a concrete pumping truck with the pouring entrance on the power head by a connecting pipe;

S5: injecting clear water into the concrete pumping truck, and pumping the water into the karst cave through the hollow drill stem to clean the karst cave;

S6: injecting commercial concrete into the concrete pumping truck, starting the concrete pumping truck, pumping the commercial concrete into the hollow drill stem through the connecting pipe, opening the one-way openable sealing cover on the reaming drill bit by the concrete streaming so that the reaming drill bit enters the karst cave, and at the same time, turning the power head slowly and reversely to lift the hollow drill stem;

S7: stopping the reaming drill bit pumping the concrete when the reaming drill bit is lifted above the top surface of the karst cave; and S8: rinsing the hollow drill stem by clear water after the hollow drill stem is completely lifted to the ground.

Further, step S2 further includes sleeving the hollow drill stem into the thin-walled steel shell and synchronous sinking of the thin-walled steel shell while drilling, wherein a steel open-type pile boot is fixedly disposed at the bottom of the thin-walled steel shell, and the hollow drill stem can do reciprocating movement relative to the thin-walled steel shell.

Further, the method also includes step S9 of inserting a reinforcement component into the concrete to form a cast-in-place pile.

Preferably, the length of the thin-walled steel shell is greater than the depth of the karst cave.

Further, the height of the reinforcement components is not ess than the depth of the karst cave.

Further, the outer diameter of the steel open-type pi boots is 10 to 20 mm more than the outer diameter of the thin-walled steel shell.

Further, the reaming drill bit drills to the stable rock stratum not less than 500 mm below the bottom surface of the karst cave.

Further, the commercial concrete is plain concrete with low slump.

Further, the diameter of the hollow drill stem is not less than 100 mm.

Further, during the construction process, the buried height of reaming drill bit in the concrete is not less than 1 in.

Compared with the prior art, the present application has the following beneficial effects:

The construction method for pouring concrete in a karst cave according to the present application utilizes a plurality of frustum-shaped concrete piers formed by low-slump plain concrete mixed with a quick-setting agent when the karst cave is relatively low, without completely filling the entire karst cave, so that the materials for treating the karst cave may be greatly reduced; when the karst cave is relatively high, the consumption of concrete and the engineering cost are reduced through a thin-walled steel shell, and the bottom of a pile formed is socketed in the stable rock stratum to further improve the bearing capacity of the steel shell cast-in-place pile; and at the same time, the construction equipment of the present application is highly mechanized, which greatly shortens the construction period compared with the existing karst cave treatment method.

BRIEF DESCRIPTION OF THE DRAWINGS

In order to describe the technical solution in embodiments of the present application or the prior art more clearly, the drawings which need to be used in the description of the embodiments or the prior art will be simply introduced below. Obviously, the accompanying drawings in the following description show merely some embodiments of the present application, and those of ordinary skill in the art may still derive other drawings according to these drawings without any creative efforts.

Figure 1:
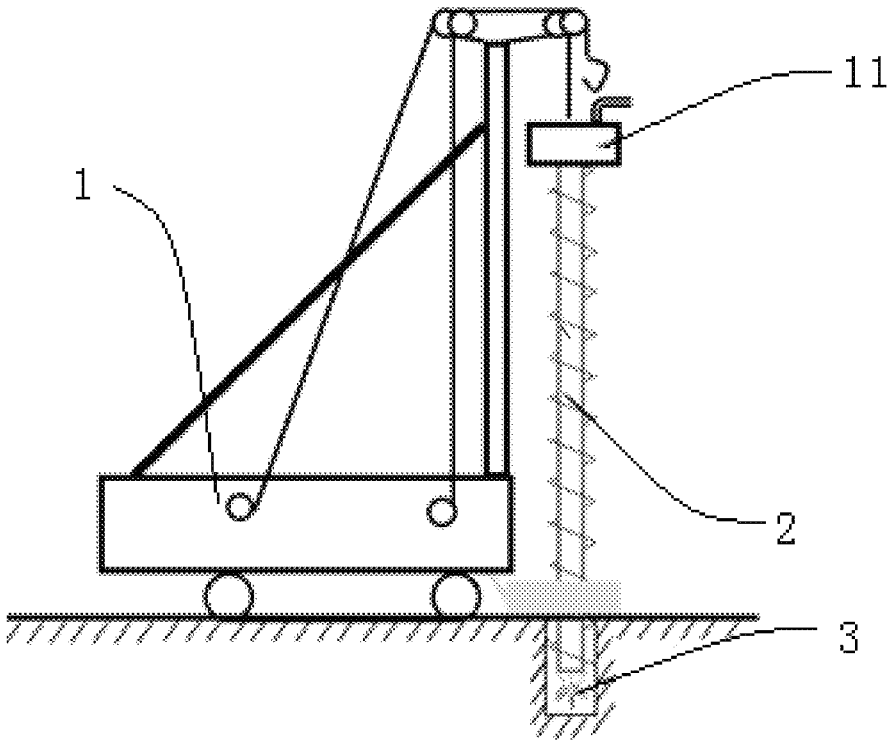
FIG. 1 is a schematic working diagram of drilling of a hollow drill stem in a construction method for pouring concrete in a karst cave according to the present application.

In which: 1—drilling rig, 11—power head, 2—hollow drill stem, 21—steel open—type pile boot, 22—thin—walled steel shell, 3—expanding bit, 31—pre—tensioned spring, 32—sealing cover, 33—hinge, 4—concrete pumping truck, 5—rubber hose, 6—karst cave, 7—concrete pier, 8—concrete column, 9—reinforcement cage, 10—building foundation surface.

DETAILED DESCRIPTION OF THE INVENTION

A clear and complete description will be made to the technical solutions in the embodiments of the present application below with reference to the accompanying drawings in the present application. Apparently, the embodiments described are only part of the embodiments of the present application, not all of them. All other embodiments obtained by those of ordinary skill in the art based on the embodiments of the present application without any creative effort shall fall within the scope of protection of the present application.

Construction equipment used in a construction method for pouring concrete in a karst cave includes a drilling rig 1, a hollow drill stem 2, an reaming drill bit 3, a concrete pumping truck 4 and a rubber hose 5, wherein the drilling rig 1 is provided with a power head 11, the power head 11 is provided with a pipe through which concrete or water passes, the hollow drill stem 2 is also provided with a passage through which concrete or water passes, one end of the pipe of the power head 11 is arranged downward and is in communication with the top of the passage of the hollow drill stem 2 arranged vertically downward, the other end of the power head 11 is provided with a protruding opening (that is, a pouring entrance), two ends of the rubber hose 5 are respectively in communication with the protruding opening and a concrete outlet of the concrete pumping truck 4, the tail end of the hollow drill stem 2 is fixedly connected to the reaming drill bit 3, the reaming drill bit 3 is provided with a slurry outlet, a hinge 33 is welded to the slurry outlet where a sealing cover 32 with a pre-tensioned spring 31 is mounted, one end of the pre-tensioned spring 31 is fixed inside the sealing cover 32 and the other end is fixed inside the slurry outlet of the reaming drill bit 3, the pre-tensioned spring 31 is initially in an extension state, and the sealing cover 32 is tightly attached to the outside of the slurry outlet under the pulling force of the pre-tensioned spring 31.

Preferably, the construction equipment used in the construction method for pouring concrete in a karst cave according to the present application further includes a thin-walled steel shell 22, steel open-type pile boots 21 are fixedly disposed at the bottom of the thin-walled steel shell 22, and the diameter of the thin-walled steel shell 22 is greater than the diameter of the hollow drill stem 2. During use, the hollow drill stem 2 extends into the inside of the thin-walled steel shell 22, and the hollow drill stem 2 can do reciprocating movement up and down relative to the thin-walled steel shell 22.

The construction method for pouring concrete in a karst cave according to the present application will be described with the above construction equipment and the following specific embodiment.

Figure 12:
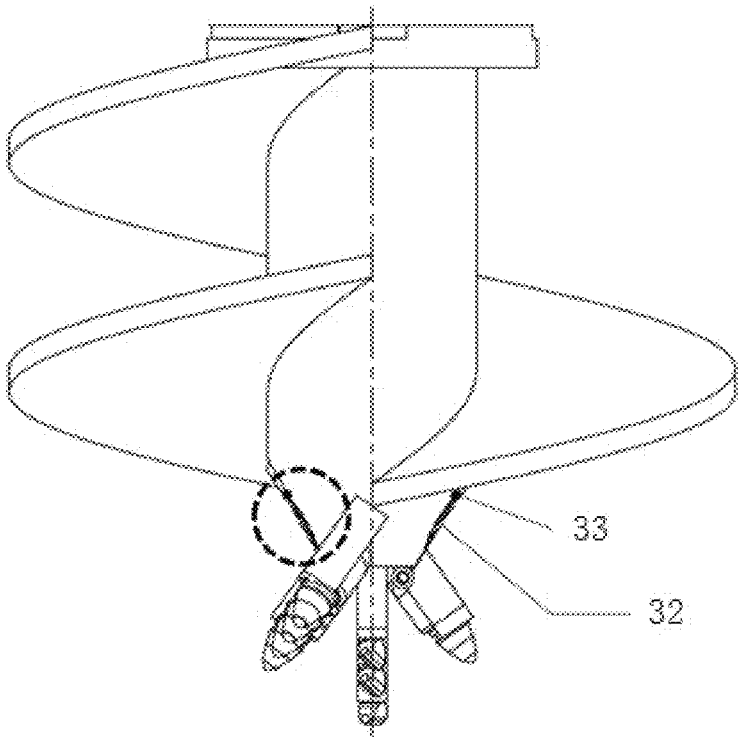
FIG. 12 is a schematic working diagram after a one-way openable sealing cover with a pre-tensioned spring is mounted on the reaming drill bit in the construction method for pouring concrete in a karst cave according to the present application.
Figure 13:
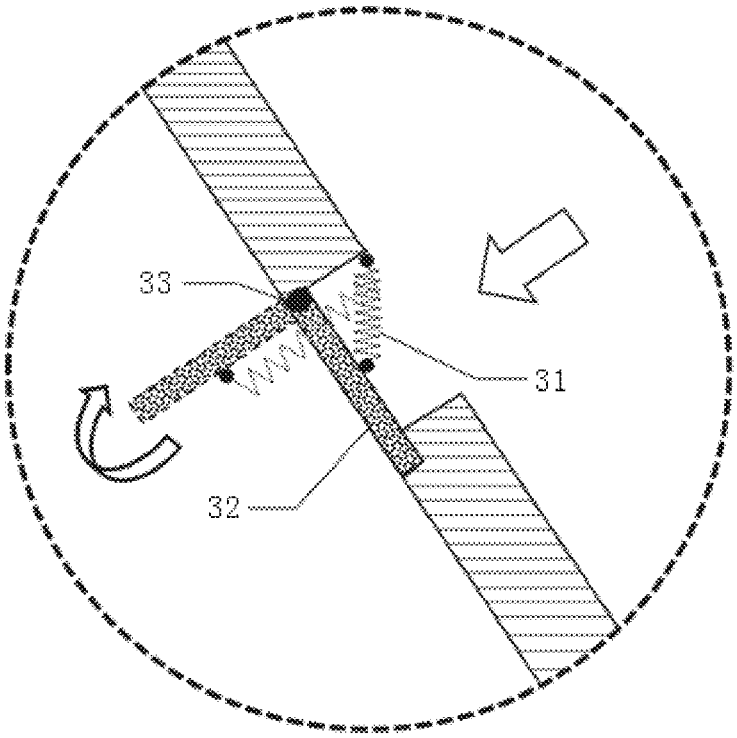
FIG. 13 is a partial enlarged sectional view of FIG. 12.

This embodiment provides a construction method for pouring concrete in a karst cave, including the following steps:

S1: As shown in FIGS. 12 and 13, the hinge 33 is welded to the slurry outlet of the reaming drill bit 3 at the tail end of the hollow drill stem 2 and the sealing cover 32 with the pre-tensioned spring 31 is mounted there, wherein one end of the pre-tensioned spring 31 is fixed inside the sealing cover 32 and the other end is fixed inside the slurry outlet of the reaming drill bit 3, the pre-tensioned spring 31 is initially in an extension state, and the sealing cover 32 is tightly attached to the outside of the slurry outlet under the pulling force of the pre-tensioned spring 31, so that the slurry outlet is completely sealed during drilling.

Figure 14:
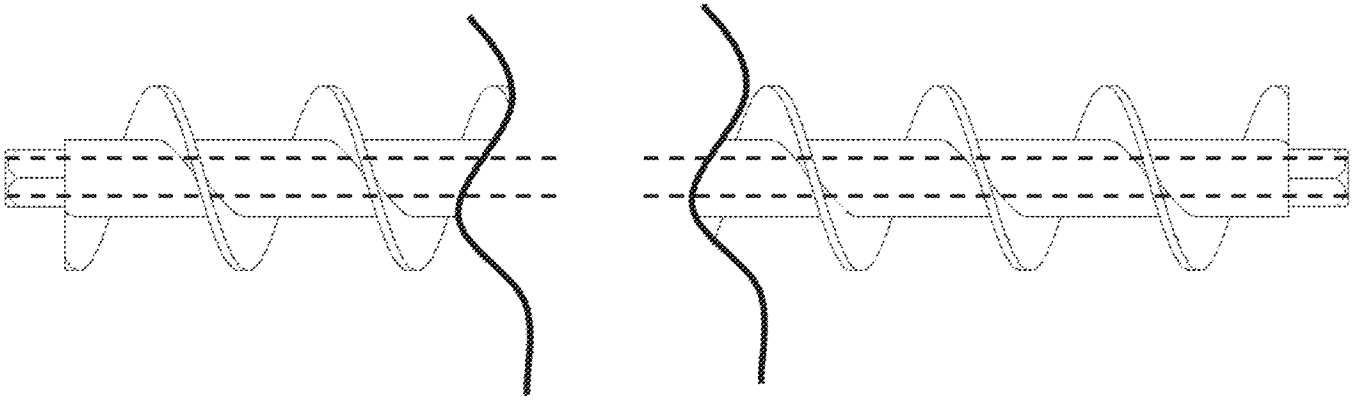
FIG. 14 is a schematic diagram of a hollow drill stem in other embodiments of the construction method for pouring concrete in a karst cave according to the present application.

S2: The drilling rig is mounted and moved to a design position above a karst cave 6 that has been surveyed and located, and the hollow drill stem 2 (the hollow drill stein is as shown in FIG. 14) is mounted on the drilling rig 1, the hollow part of the hollow drill stem 2 having a diameter of not less than 100 mm. It can be understood that concrete is mixed with many different sizes of stones, cement, etc. If the diameter of the hollow part of the hollow drill stem 2 is less than 100 mm, the concrete may not flow, flow slowly or be directly stuck in the hollow drill stem 2, so that the construction process cannot be carried out.

Figure 2:
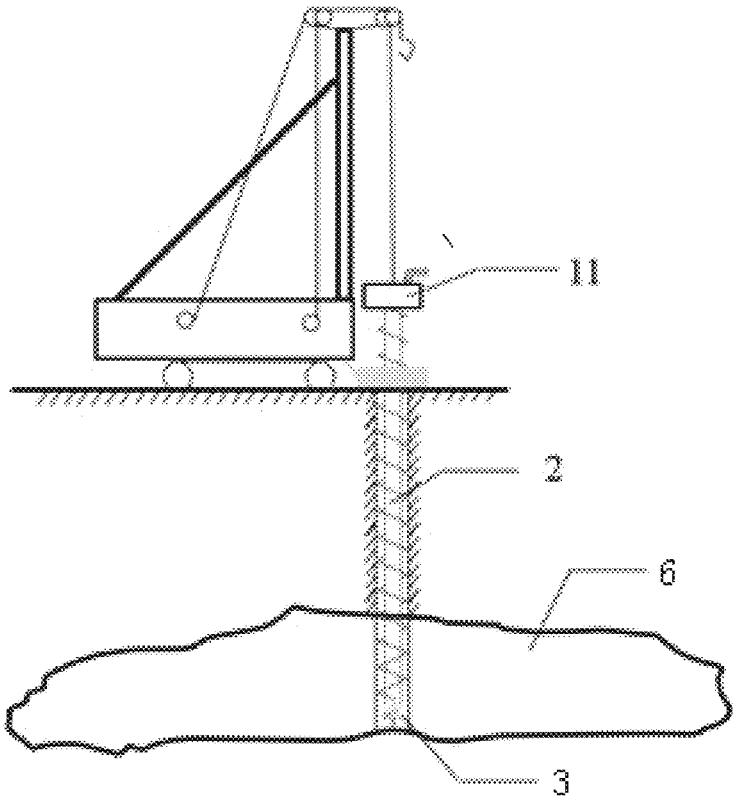
FIG. 2 is a schematic working diagram of drilling of the hollow drill stem to the bottom surface of a karst cave in the construction method for pouring concrete in a karst cave according to the present application.

S3: As shown in FIGS. 1 and 2, the power head 11 of the drilling rig 1 is rotated forward for drilling, muck is brought out of the drilling hole by spiral blades on the hollow drill stem 2, the muck brought out of the drilling hole by the spiral blades is continually cleared till the reaming drill bit 3 drills to the bottom of the karst cave 6, and the drilling operation is completed at this time. It should be noted that the drilling stops when the hollow drill stem touches the bottom surface of the karst cave if the depth of the karst cave is less than 3 m; and the drilling stops when the hollow drill stem passes through the bottom surface of the karst cave and socketed into stable rock stratum if the depth of the karst cave is no less than 3 m. The karst cave in this embodiment is generally below the ground, a foundation surface of a building is above the karst cave, and a stable rock stratum surface (i.e., a stable rock stratum) is below the karst cave. The stable rock stratum can be understood as a solid rock stratum with certain bearing capacity. In addition, the forward rotation or reverse rotation of the reaming drill bit in the present application is not the forward rotation or reverse rotation in the actual working condition, but to illustrate different directions of rotation of the drilling rig in the drilling process and the lifting process of the hollow drill stem.

S4: The concrete outlet pipe of the concrete pumping truck 4 is connected to the pouring entrance of the power head 11 by the rubber hose 5. Of course, this embodiment can also choose other connection methods, such as steel pipe connection, as long as the purpose of communication can be achieved.

S5: Clear water is injected into the concrete pumping truck 4 and pumped into the hollow drill stem 2 from the concrete pumping truck 4 under water pressure, and the clear water opens the sealing cover 32 with the pre-tensioned spring 31 on the reaming drill bit 3 through the hollow drill stem 2 and flows out to flush and clean the stuff in the karst cave 6. By flushing the karst cave, the stuff such as garbage in the karst cave can be flushed out of the drill hole, so that the quality of concrete molding is further improved.

Figure 3:
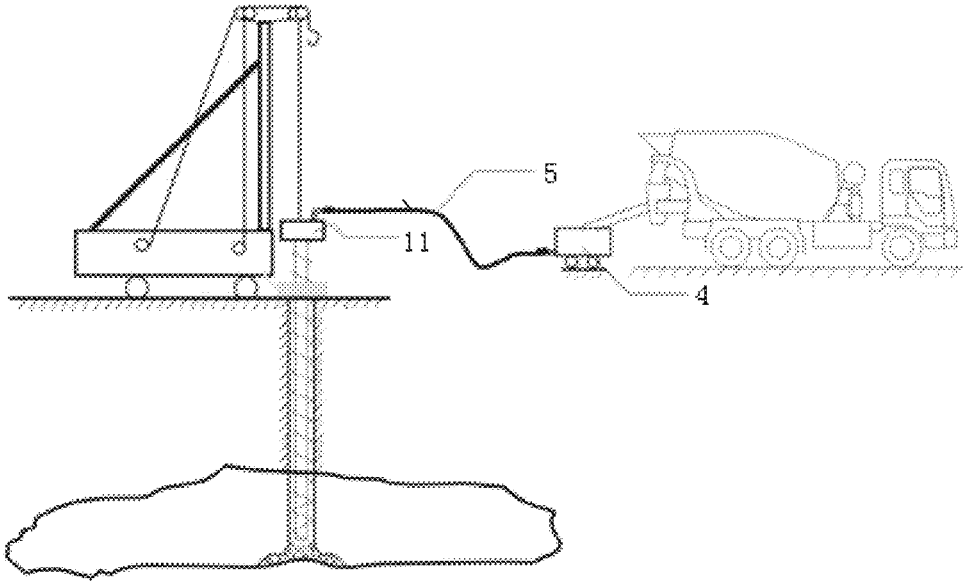
FIG. 3 is a schematic working diagram of injection of concrete by the hollow drill stem in the construction method for pouring concrete in a karst cave according to the present application.
Figure 4:
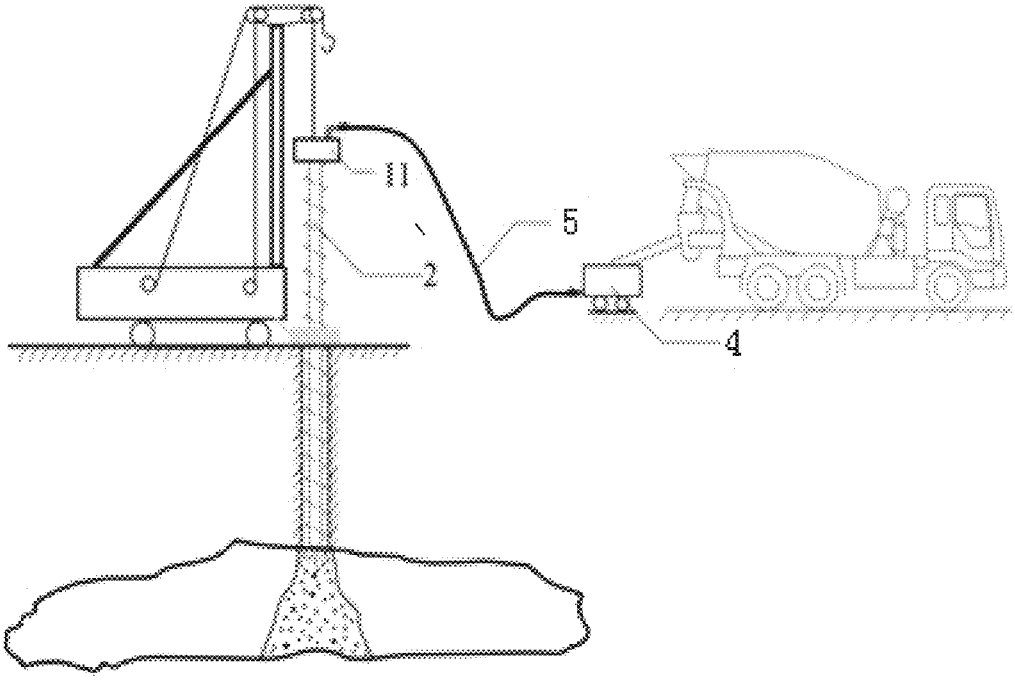
FIG. 4 is a schematic working diagram showing that a reaming rill bit is completely lifted above the top of the karst cave to form a concrete pier in the construction method for pouring concrete in a karst cave according to the present application.

S6: As shown in FIGS. 3 and 4, plain concrete with low slump is injected into the concrete pumping truck 4, the concrete pumping truck 4 is started, and the concrete with low slump is pumped into the hollow drill stem 2 through the rubber hose 5; the concrete opens the sealing cover 32 with the pre-tensioned spring 31 on the reaming drill bit 3 through the hollow drill stem 2 and enters the karst cave 6, the power head 11 is slowly reversed at the same time to lift the hollow drill stem 2, and the buried depth of the reaming drill bit into the concrete is always no less than 1 m. It can be understood that the reaming drill bit 3 is buried in the concrete, and the concrete bursts out from the bottom to the top after coming out of the hollow drill stem 2, which can stir silt, garbage, etc. to the top, ensure full pouring and no holes, and ultimately ensure sufficient strength of the solidified concrete. It should be rioted that the low-slump plain concrete used in this embodiment has good vibration resistance, the phenomena of bleeding, delamination and floating slurry are unlikely to occur after fresh concrete is violently vibrated, the uniformity of concrete can be well maintained, and the concrete has good wrapping property and workability; and due to the low slump, the water consumption of the concrete is reduced, the guarantee rate of strength is higher, the dryness of the concrete is reduced, and the crack resistance is enhanced.

S7: The reaming drill bit stops pumping the concrete when the reaming drill bit 3 is completely lifted above the top surface of the karst cave 6, and a continuous cast-in-place frustum-shaped concrete pier 7 is formed in the karst cave 6.

S8: The hollow drill stem 2 is completely lifted to the ground and then flushed with clear water, and the construction of a concrete pier is completed.

Figure 5:
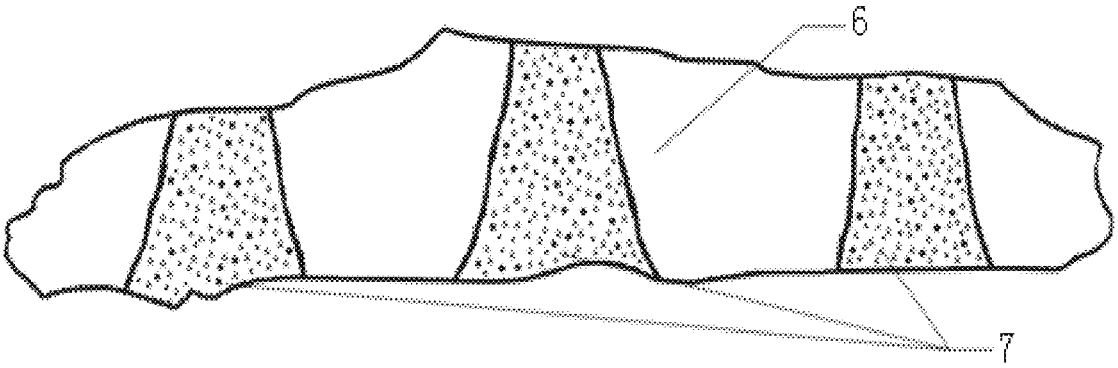
FIG. 5 is a cross-sectional view of concrete piers formed in FIG. 4.
Figure 6:
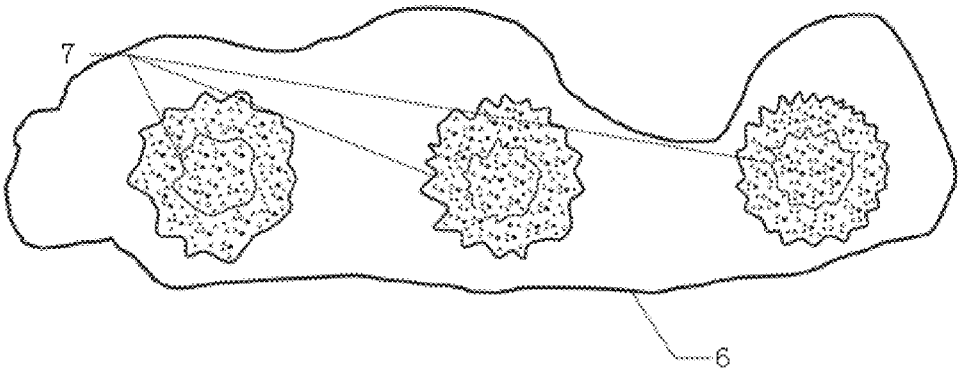
FIG. 6 is a plan view of the concrete piers formed in FIG. 4.

Steps S1 to S8 above are repeated to form a plurality of frustum-shaped concrete piers 7 required for the design in the karst cave, as shown in FIGS. 5 and 6. The concrete piers 7 maintain the stability of the karst cave and support the basement foundation of a building.

The construction method for pouring concrete in a karst cave according to the present application utilizes the plurality of frustum-shaped concrete piers formed by low-slump plain concrete mixed with quick-setting agents, without completely filling the entire karst cave, so that the materials for treating the karst cave can be greatly reduced, the process is simple, and the construction period is short. The construction method of this embodiment is more suitable for the karst caves having small depths (the depths of the karst caves are less than 3 m).

Preferably, in other embodiments, step S2 further includes that the hollow drill stem 2 is sleeved into the thin-walled steel shell 22 and the thin-walled steel shell 22 is synchronously sunk into the drilled hole while drilling. A steel open-type pile boot 21 is fixedly disposed at the bottom of the thin-walled steel shell 22, and the hollow drill stem 2 can do reciprocating movement up and down relative to the thin-walled steel shell 22, that is, there is a gap between the thin-walled steel shell 22 and the hollow drill stem 2, and the two do not contact each other. The thin-walled steel shell is socketed into the stable rock stratum after entering the karst cave.

Figure 15:
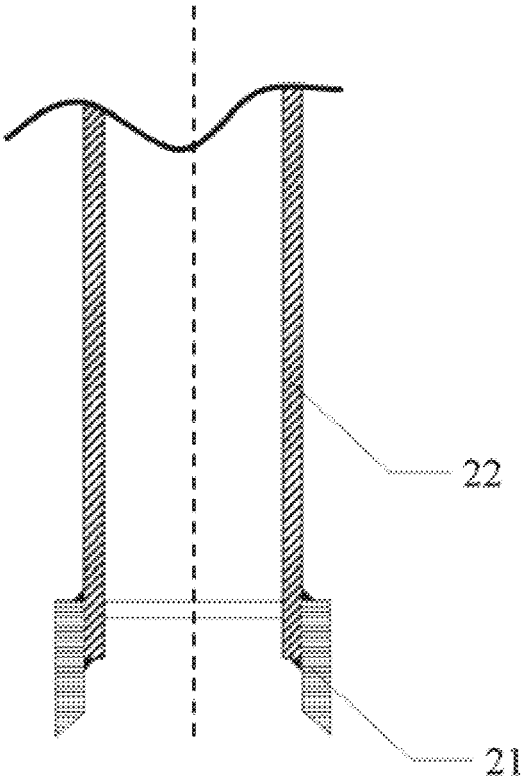
FIG. 15 is a schematic diagram showing that steel open-type pile hoot is welded to the bottom of a thin-walled steel shell in other embodiments of the construction method for pouring concrete in a karst cave according to the present application.

Specifically, as shown in FIG. 15, the steel open-type pile boot 21 needs to be welded to the bottom of the thin-walled steel shell 22. The outer diameter of the steel open-type pile boot 21 is 10-20 mm more than the outer diameter of the thin-walled steel shell 22 to form a cut soil cavity so as to ensure that the steel shell sinks with the drill bit. During construction, the hollow drill stem 2 is extended into the thin-walled steel shell 22 welded with steel open-type pile boot 21 at the bottom. The diameter of the hollow drill stem 2 is slightly smaller than that of the thin-walled steel shell 22, which ensures that the hollow drill stem 2 can freely do reciprocating movement up and down in the thin-walled steel shell 22. It can be understood that the thin-walled steel shell 22 plays a role in limiting the shape of a concrete column formed after the concrete is solidified. The thin-walled steel shell 22 eventually falls to the bottom of the karst cave with the hollow drill stem 2.

Figure 7:
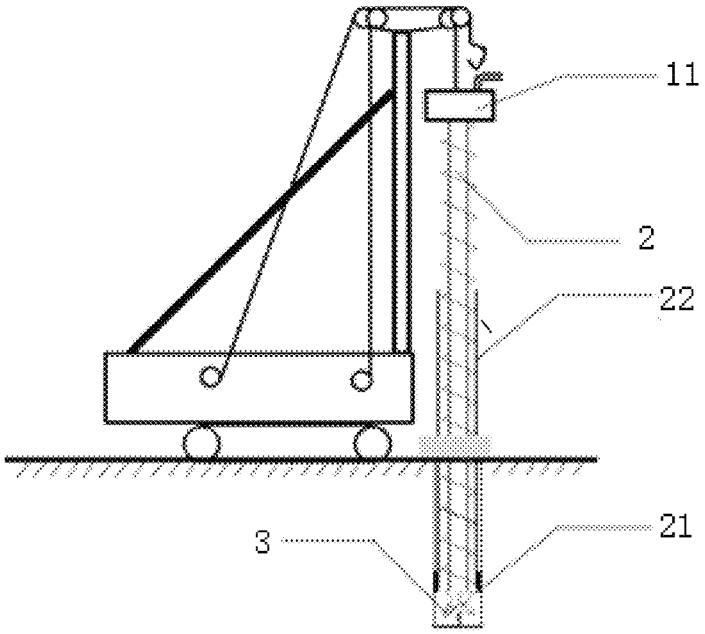
FIG. 7 is a schematic working diagram of drilling of the hollow drill stem in other embodiments of the construction method for pouring concrete in a karst cave according to the present application.
Figure 8:
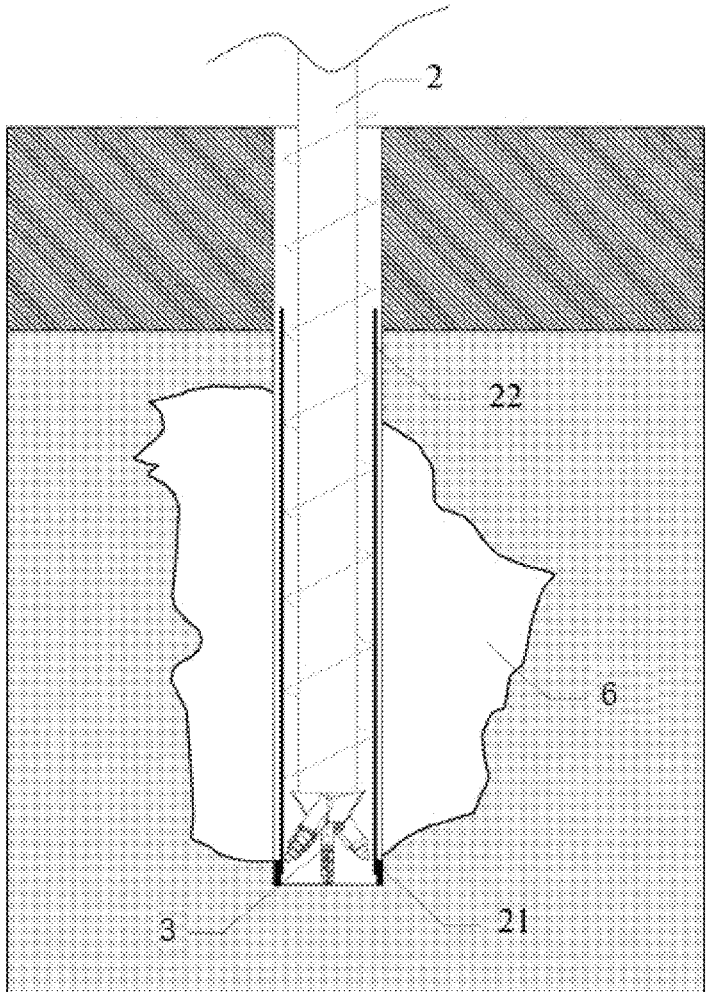
FIG. 8 is a schematic working diagram of drilling of the hollow drill stem to the bottom surface of a karst cave in other embodiments of the construction method for pouring concrete in a karst cave according to the present application.

Specifically, as shown in FIGS. 7 and 8, during construction, the power head 11 of the drilling rig 1 is rotated forward to drill a hole, the thin-walled steel shell 22 is synchronously sunken, and muck brought out of the hole by the spiral blades is continually cleared till the reaming drill bit 3 passes through the bottom of the karst cave 6 and is socketed into the stable rock stratum. In this embodiment, the reaming drill bit drills the stable rock stratum at the bottom of the karst cave in order that the steel open-type pile boot 21 at the lower part of the thin-walled steel shell 22 cuts soil and enters the stable rock stratum to support the stability of the entire thin-walled steel shell 22 in the karst cave. When the length of the thin-walled steel shell 22 is smaller than the depth of the karst cave, the thin-walled steel shell 22 can still be stabilized in the karst cave, so as not to tilt to interfere with the hollow drill stem 2.

Figure 9:
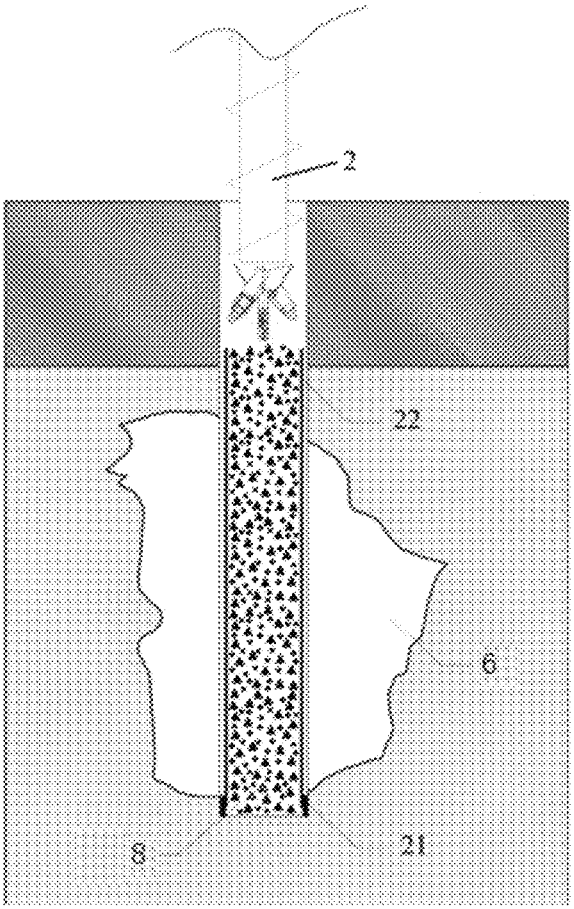
FIG. 9 is a schematic working diagram of injection of concrete by the hollow drill stem to form a concrete column in other embodiments of the construction method for pouring concrete in a karst cave according to the present application.

The thin-walled steel shell 22 is provided in this embodiment to enclose a certain space in the karst cave, which can limit the shape of the concrete cast-in-place pile, so that materials are saved, and the needs of basic bearing force can be better met. FIG. 9 is a schematic diagram showing that concrete is poured into the thin-walled steel shell in the karst cave.

Further, the length of the thin-walled steel shell 22 is greater than the depth of the karst cave, the thin-walled steel shell 22 penetrates the entire depth of the karst cave, and the sinking depth of the steel open-ended pile boot 21 at the bottom of the thin-walled steel shell 22 into the stable rock stratum is not less than 500 mm (that is, the reaming drill bit drills to the stable rock stratum of not less than 500 mm below the bottom surface of the karst cave). It can be understood that if the reaming drill bit 3 drills to less than 500 mm below the bottom surface of the karst cave 6, the rock socketing effect will be lost. The Code for Design of Building Foundation (GB50007) states that the circumference of a rock-socketed cast-in-place pile is socketed into complete and relatively complete hard rocks by a minimum depth not less than 500 mm.

Preferably, in other embodiments, the method further includes step S9 that reinforcement components are inserted into the concrete to form a cast-in-place pile, and the height of the reinforcement components is not less than the depth of the karst cave. The reinforcement components in this embodiment are reinforcement cages 9 or steel pipes. Of course, other reinforcement components can also be used, as long as they have certain stiffness to achieve a supporting effect, and they all fall into the protection scope of the present application.

Figure 10:
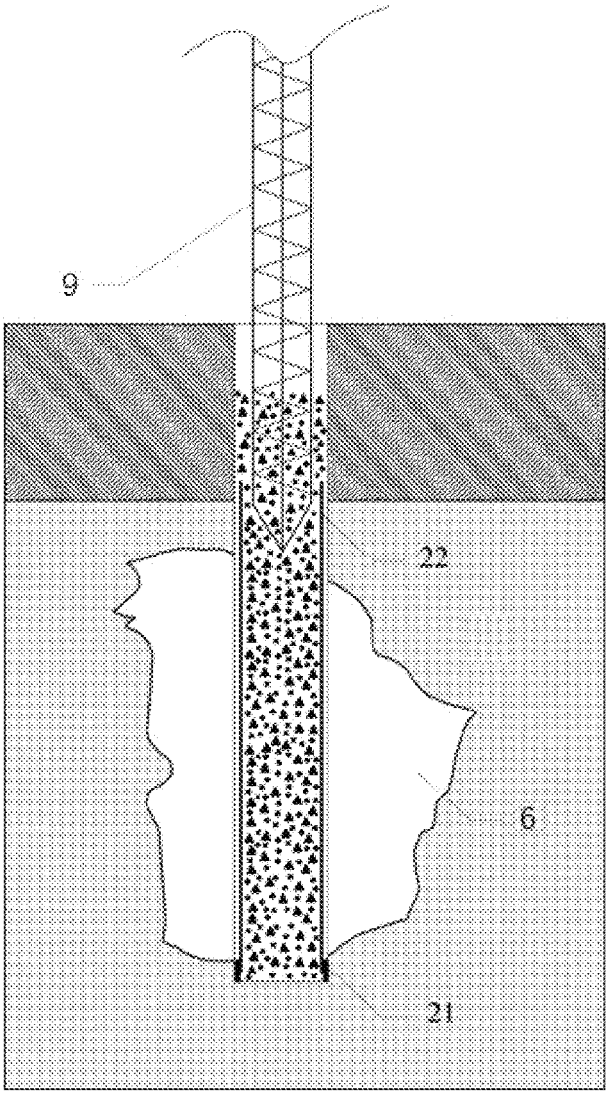
FIG. 10 is a schematic working diagram of insertion of a reinforcement cage into the concrete column in other embodiments of the construction method for pouring concrete in a karst cave according to the present application.
Figure 11:
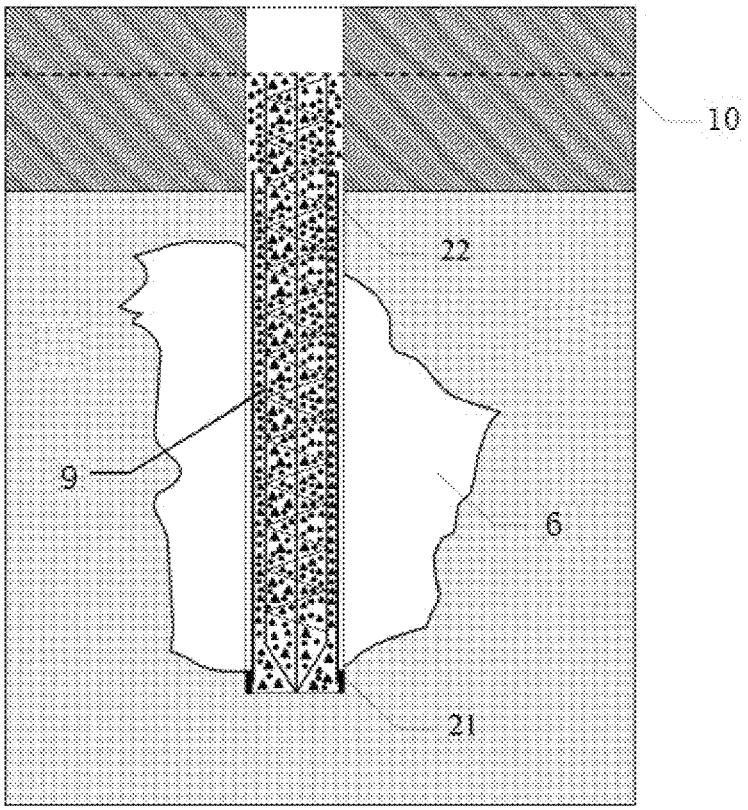
FIG. 11 is a schematic diagram of a steel shell cast-in-place pile formed in other embodiments of the construction method for pouring concrete in a karst cave according to the present application.

Specifically, as shown in FIGS. 10 and 11, a reinforcement cage 9 or steel pipe is inserted into the concrete column S with a vibratory hammer to form a steel shell cast-in-place pile. The upper end of the reinforcement cage 9 or steel pipe is not lower than the bottom surface of a building foundation surface 10.

The construction method for pouring concrete in a karst cave according to the present application greatly reduces the consumption of concrete and the engineering cost through the thin-walled steel shell, and the bottom of the pile formed is socketed in the stable rock stratum to further improve the bearing capacity of the steel shell cast-in-place pile. At the same time, the construction equipment of the present application is highly mechanized, which greatly shortens the construction period compared with the existing karst cave treatment method. The construction method of this embodiment is suitable for karst caves of any depth, especially for the karst caves having large depths (the depths of the karst caves are more than 3 m).

The present application is further described above by virtue of specific embodiments, but it should be appreciated that the specific description here should not be understood as limitations to the essence and scope of the present application. Various modifications made to the above embodiments by those of ordinary skill in the art after reading the description shall fall within the protection scope of the present application.

What is claimed is:

1. A construction method for pouring concrete in a karst cave, comprising the following steps:

S1: mounting a one-way openable sealing cover at a slurry outlet of a reaming drill bit at the tail end of a hollow drill stem, wherein the one-way openable sealing cover is configured to open and close the slurry outlet, and the hollow drill stem comprises a passage through which concrete or water passes;

S2: mounting a drilling rig above the karst cave and mounting the hollow drill stem on the drilling rig;

S3: starting the power head of the drilling rig to perform positive drilling into the unstirred stratum, cleaning muck around the opening of the drilled hole, and stopping the drilling when the hollow drill stem touches the bottom surface of the karst cave if the depth of the karst cave is less than 3 m; or stopping the drilling when the hollow drill stem passes through the bottom surface of the karst cave and is socketed into stable rock stratum if the depth of the karst cave is no less than 3 m:

S4: connecting the concrete outlet of a concrete pumping truck with the pouring entrance on the power head by a connecting pipe:

S5: leading water into the concrete pumping truck, and pumping the water into the karst cave through the hollow drill stem to clean the karst cave;

S6: leading concrete into the concrete pumping truck, starting the concrete pumping truck, pumping the concrete into the hollow drill stem through the connecting pipe; opening the one-way openable sealing cover on the reaming drill bit by the concrete streaming so that the concrete enters into the karst cave, and at the same time, turning the power head slowly and reversely to lift the hollow drill stem;

S7: stopping reaming drill bit pumping the concrete when the reaming drill bit is lifted above the top surface of the karst cave; and S8: rinsing the hollow drill stem by water after the hollow drill stem is completely lifted to the ground.

2. The construction method according to claim 1, wherein the step S2 further comprises sleeving the hollow drill stem into a thin-walled steel shell and the synchronous sinking of the thin-walled steel shell while drilling, wherein a steel open-type pile boot is fixedly disposed at the bottom of the thin-walled steel shell, and the hollow drill stem is operative to perform reciprocating movement relative to the thin-walled steel shell.

3. The construction method according to claim 2, further comprising step S9:

inserting reinforcement components into the concrete to form a cast-in-place pile.

4. The construction method according to claim 3, wherein the thin-walled steel shell has a length that is greater than the depth of the karst cave.

5. The construction method according to claim 3, wherein the reinforcement components each have a height that is not less than the depth of the karst cave.

6. The construction method according to claim 3, wherein the steel open-type pile boots has an outer diameter that is 10 to 20 mm greater than the outer diameter of the thin-walled steel shell.

7. The construction method according to claim 3, wherein a socketed depth of the reaming drill bit into the stable rock stratum is not less than 500 mm.

8. The construction method according to claim 3, wherein the reinforcement components comprise reinforcement cages or steel pipes, wherein the upper end of the reinforcement components is not lower than the bottom surface of a building foundation surface.

9. The construction method according to claim 2, wherein the steel open-type pile boot has a greater outer diameter than that of the thin-walled steel shell and is fixedly sleeved outside the thin-walled steel shell.

10. The construction method according to claim 9, wherein the outer diameter of the steel open-type pile boot is greater than that of the thin-walled steel shell by 10 to 20 mm.

11. The construction method according to claim 2, wherein in the case where the depth of the karst cave is greater than 3 meters, the step S2 further comprises sleeving the hollow drill stem into a thin-walled steel shell and synchronous sinking of the thin-walled steel shell while drilling, wherein a steel open-type pile boot is fixedly disposed at the bottom of the thin-walled steel shell, and the hollow drill stem is operative to perform reciprocating movement relative to the thin-walled steel shell, and wherein in S3 the hollow drill stem is stopped from drilling when passing through the bottom surface of the karst cave and is socketed into stable rock stratum.

12. The construction method according to claim 1, wherein the concrete is plain concrete with low slump, wherein in the case where the depth of the karst cave is less than 3 meters, in step S3 the hollow drill stem is stopped from drilling when touching the bottom surface of the karst cave, and in step S6 a plurality of frustum-shaped concrete piers are formed by the low-slump plain concrete mixed with a quick-setting agent, without completely filling the entire karst cave.

13. The construction method according to claim 1, wherein the hollow drill stem has a diameter that is not less than 100 mm.

14. The construction method according to claim 1, wherein during the construction process, a height of the reaming drill bit buried in the concrete is not less than 1 m.

15. The construction method according to claim 1, wherein there is a hinge that is welded to the slurry outlet and the one-way openable sealing cover is pivotally connected to the hinge, wherein there is further arranged a pre-tensioned spring, one end of which is fixed inside the sealing cover and another end of which is fixed inside the slurry outlet of the reaming drill bit, wherein the pre-tensioned spring is initially in an extension state, and the one-way openable sealing cover is tightly attached to the outside of the slurry outlet under the action of a pulling force of the pre-tensioned spring so that the slurry outlet is completely sealed during drilling.

16. The construction method according to claim 1, wherein the hollow drill stem comprises a central hollow tube and a spiral plate that is fixed to or integrally formed with the central hollow tube, and wherein the passage is defined in the central hollow tube through which concrete or water passes.

17. The construction method according to claim 1, further comprising:

repeating the steps S1 through S8 to form a plurality of frustum-shaped concrete piers in the karst cave to maintain the stability of the karst cave and support the basement foundation of a building.

18. A construction system for pouring concrete into a karst cave, comprising a drilling rig, a hollow drill stem, an reaming drill bit, a concrete pumping track, and a rubber hose, wherein the drilling rig comprises a power head, the power head comprising a pipe used to guide concrete or water; wherein the hollow drill stem comprises a passage used to guide concrete or water, wherein one end of the pipe of the power head is arranged downward and is in communication with the top of the passage of the hollow drill stem arranged vertically downward, wherein another end of the power head is provided with a protruding opening serving as a pouring entrance; wherein two ends of the rubber hose are respectively in communication with the protruding opening and a concrete outlet of the concrete pumping truck; wherein a tail end of the hollow drill stem is fixedly connected to the reaming drill bit; the reaming drill bit comprises a slurry outlet; wherein a hinge is welded to the slurry outlet where a sealing cover with a pre-tensioned spring is mounted, one end of the pre-tensioned spring is fixed inside the sealing cover and the other end is fixed inside the slurry outlet of the reaming drill bit; wherein the pre-tensioned spring is initially in an extension state, and the sealing cover is tightly attached to the outside of the slurry outlet under the action of a pulling force of the pre-tensioned spring.

19. The construction system according to claim 18, wherein the sealing cover is a one-way openable sealing cover configured to open and close the slurry outlet.

20. The construction system according to claim 18, further comprising a thin-walled steel shell that is sleeved outside the hollow drill stem and that is allowed to sink synchronously with the thin-walled steel shell while drilling, wherein the thin-walled steel shell comprises a steel open-type pile boot that is fixedly disposed at the bottom of the thin-walled steel shell, and wherein the hollow drill stem is operative to reciprocate relative to the thin-walled steel shell.

* * * * *